United States Patent [19]

Nangle et al.

[11] 4,095,119

[45] June 13, 1978

[54] SYSTEM FOR RESPONDING TO A PARTIAL LOSS OF LOAD OF A TURBINE POWER PLANT

[75] Inventors: Bernard Nangle; Patrick L. McGaha, both of West Chester; Thomas J. Wallace, Upper Chichester, all of Pa.; Todd B. Anderson, Hammond, Ind.

[73] Assignee: Westinghouse Electric Corp., Pittsburgh, Pa.

[21] Appl. No.: 699,295

[22] Filed: Jun. 23, 1976

[51] Int. Cl.[2] ..... F01K 13/02

[52] U.S. Cl. ..... 290/40 R; 60/646

[58] Field of Search ..... 60/660, 646, 653, 663; 290/40

[56] References Cited

U.S. PATENT DOCUMENTS 3,999,787 12/1976 Park ..... 60/646

*Primary Examiner*—Gene Z. Rubinson
*Assistant Examiner*—John W. Redman
*Attorney, Agent, or Firm*—W. E. Zitelli

[57] ABSTRACT

An electrohydraulic system for rapidly reducing the steam flow through the high pressure and lower pressure stages of a turbine power plant in response to a partial loss of electrical load, is disclosed. In response to the detection of a partial loss of load, the system provides for controlling a portion of the governor valves and all of the interceptor valves to close rapidly and independently of the turbine control system; also to operate the turbine control system to cause the remaining governor valves to operate to a predetermined partially closed condition independent of the normal governor valve reference demand signal by applying a signal for changing the open limit position of the governor valves; and to eliminate the affect of the impulse pressure loop from the turbine control system. The upper valve position limit signal and the slower rate of change reference demand signal is matched to the applied signal. Restoration of a predetermined total steam flow to the lower stage of the turbine is provided through a combination of a rapid opening of the interceptor valves followed by a slower opening where such rapid to slower opening is governed by a signal representative of the additive position of all the interceptor valves. After an adjustable time delay all the governor valves are controlled in accordance with the reduced valve position limit signal, then can be controlled by the total reference demand signal under normal control at a sustained reduced load.

10 Claims, 5 Drawing Figures

SYSTEM FOR RESPONDING TO A PARTIAL LOSS OF LOAD OF A TURBINE POWER PLANT

BACKGROUND OF THE INVENTION

1. Field of the Invention

The present invention relates to a turbine power plant system that responds to a loss of electrical load to rapidly reduce the turbine generator output and following a system load disturbance operate at a sustained reduced load.

2. Description of the Prior Art

Electric power from a turbine generating plant may be transmitted over many miles of electric cable; and in many instances more than one geographically spaced turbine power plant may be connected to, or feeding the same transmission line, with each plant contributing to the total load. It is customary to transmit each phase of a three phase alternating current, for example, over transmission lines which are spaced apart sufficiently so that damage to one line by an extraneous cause, such as lightning, is unlikely to damage an adjacent cable. However, in the event that one of the transmission lines is broken or shorted close to the generating plant, the electrical load produced by such plant is suddenly reduced. This results in the unit's tending to speed up, which may taken it out of synchronism with the other plants.

In the past, this problem of short circuits or line faults, which resulted in a partial load reduction, was solved by taking the plant off the line; that is, tripping the turbine. However, in such an event where other units are contributing load to the same transmission line, the taking of one plant off line may cause the other turbine power plants to trip. Another proposed way of minimizing the likelihood of instability due to a line fault is to utilize one or more spare transmission lines so that the detection of a fault on one line causes a transfer of the output to a spare line.

Another way of preventing a turbine power plant from getting out of synchronism upon the occurrence of a partial load reduction is to effect what is commonly known as "fast valving", which involves a rapid momentary reduction in the admission of steam to the turbine power plant in response to the detection of a line fault to keep the turbine from tripping. In such power plants, where the turbine has more than one pressure stage, the low pressure stage or section provides approximately 70% of the driving power of the turbine. Thus, the governor valves, which control the flow of steam to the high pressure section in accordance with the desired load, would not cause sufficient rapid reduction of the turbine output to prevent the tripping of the turbine even if they were all fully closed rapidly. The steam to the lower pressure stages is conducted from the exhaust of the high pressure section through steam reheating apparatus and a plurality of intercept valves to the lower pressure turbine section. The interceptor valves are normally operated to a fully open position to admit the flow of steam from the high to the lower pressure sections. The rapid closing and opening of the interceptor valves until the line fault is removed or the proper load is restored as described in U.S. Pat. No. 3,843,437, is effective to prevent the tripping of the turbine in the case of a partial load reduction. However, such a transient type situation causes a pressure buildup upstream of the interceptor valves in response to the closure, and a sudden rush of steam in response to the opening. This may cause pressure shocks, temperature swings on the turbine blading, and "secondary swings" of power on the grid system.

In the past, it has been proposed to rapidly close the interceptor valves and then open them rapidly for a portion of their stroke and then slowly open such valves until they are fully open. This of course cuts off the steam supply momentarily to the lower pressure turbine stages and minimizes the sudden rush of steam by restricting the rapid reopening. Also, it has been proposed to rapidly close a portion of the governor valves in order to reduce the steam flow to the HP turbine.

In present electrohydraulic control systems, either digital or analog, there is usually provided an electrical reference demand signal which controls the total steam flow to the turbine by controlling the governor valves in either a single or a sequential mode. However, for adequacy of normal control the rate of change of such signal is limited. Also, such control systems normally operate in an automatic mode with an impulse pressure feedback loop in service to maintain a constant load on the system. Thus, it is important that a "fast valving" system be compatible with such electrohydraulic control systems so that "fast valving" in response to a line fault, does not affect the proper operation of the turbine control system; and that such system is restored to control the normal operation of the turbine at a predetermined sustained reduced load with such transition being effected without abrupt changes in valve position.

U.S. Pat. No. 3,848,138 suggests certain of the previously discussed concepts of opening and closing the intercept and governor valves; and presents in detail the history of fast valving. Also, systems have been proposed for fast valving and for stabilizing a steam generator after run back of the load in U.S. Pat. Nos. 3,601,617 and 3,609,384. Although, such patents have proposed various systems for fast valving, a system that is capable of utilizing the described well-known fast valving concepts, yet is readily adaptable to modern electrohydraulic turbine control systems, eliminating the effect of the impulse pressure fluctuations, closing one portion and decreasing the opening a predetermined of another portion of the governor valves independent of the reference demand signal to overcome the inherent relative slow rate of change of the reference demand signal, or which provides for rapid restoration of a decreased total flow of steam to the lower turbine pressure stages regardless of the sticking or slow operation of one or more of the interceptor valves, and which provides for a smooth transition to normal turbine control at a sustained reduced load has not been shown insofar as is known.

Thus, it is desirable to provide an improved fast valving system that provides the necessary protection to the steam turbine generator in response to a load fault signal, and overcomes the limitations of, and is comparable with a modern electrohydraulic system.

SUMMARY OF THE INVENTION

A system for rapidly reducing the total steam flow to the lower pressure turbine section of a power plant upon the occurrence of a partial loss of load includes means for providing an additive intercepter valve position signal for controlling the rapid to slower opening of the interceptor valves after a rapid closing. The system also provides for the reduction of steam to the high pressure turbine section of the power plant in response to an input indicative of loss of load by closing one portion of the governor valves and reducing the opening of another portion independent of and irrespective of the rate of changes of the governor valve position demand reference signal with the reduction of the opening of the other portion effected rapidly by the application of a predetermined total governor valve position voltage to which the valve limit position signal and reference demand signal is tracked. Further, the system provides for eliminating undesirable governor valve position changes by simultaneously removing the effect of the impulse pressure feedback loop of the electrohydraulic turbine system. A sustained load reduction is maintained by restoring control of all the governor valves to control of a signal corresponding to the limit position signal. The reference demand signal for all of the governor valves is changed in accordance with the valve position limit signal.

DESCRIPTION OF THE PREFERRED EMBODIMENT

Figure 1:
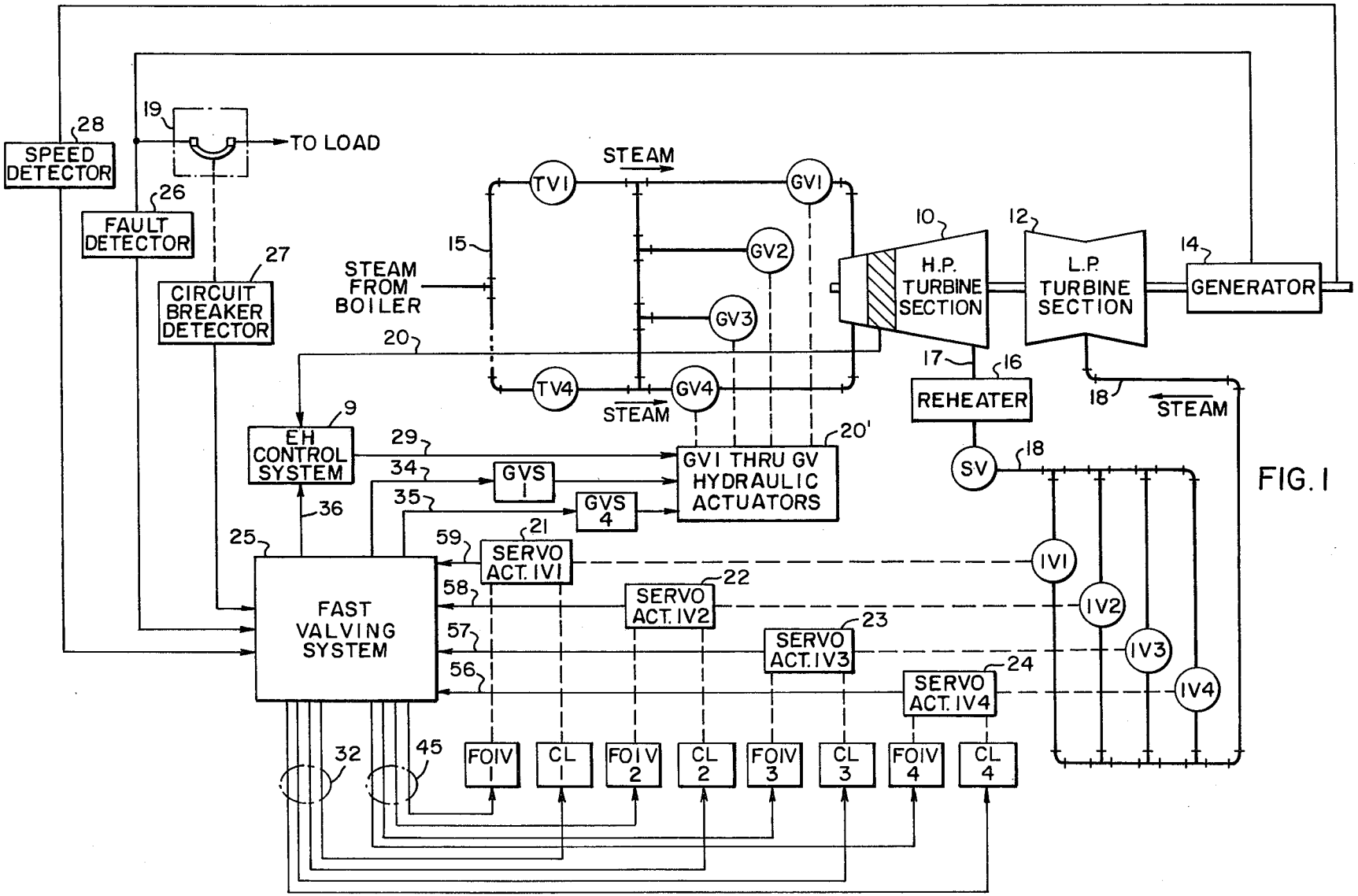
FIG. 1 illustrates schematically in block diagram form a turbine power plant utilizing the system of the present invention.

Referring to FIG. 1, there is shown an electrohydraulic turbine generator power plant having a high pressure (HP) turbine unit 10, and a low pressure (LP) turbine unit 12 connected in tandem and jointly driving an electric generator 14. Additional turbine stages may also be provided, such as additional high and low pressure sections and one or more intermediate pressure turbine sections located between the high and low pressure sections. In a typical installation the low pressure section provides approximately 70% of the driving power.

High pressure steam from any suitable supply, for example, a nuclear reactor (not shown) is admitted to the HP turbine unit 10 via piping 15 having interposed therein the usual throttle valves TV1 through TV4 and a plurality of governor valves GV1 through GV4. The governor valves GV are controlled under normal operating conditions by either a digital or analog electrohydraulic control system 9 hereinafter referred to as an EH control system. After partial expansion in the high pressure turbine unit 10, the steam is directed to suitable reheating apparatus 16 via piping 17; and the reheated steam is then directed to the low pressure turbine unit 12 by piping 18 for further expansion. The piping 18 has one or more conventional reheat stop valves SV therein, and a plurality of interceptor valves IV1 through IV4 interposed downsteam of the reheat stop valve SV. It is understood that there may be more or less throttle valves TV, governor valves GV, stop valves SV, or interceptor valves IV depending on the particular installation.

In normal load operation, as thus far described, the throttle valves TV, the reheat stop valve SV, and the interceptor valves IV are fully opened; and the governor valves GV are regulated by the EH controller in accordance with a reference demand signal to the degree of opening required to admit high pressure steam to the turbine units at a rate effective to satisfy the load requirements of the generator 14. An impulse pressure feedback loop represented by line 20 is normally in service to insure constant load output during variations of steam pressure in the impulse chamber. The electrical output from the generator 14 passes to the load through a suitable main circuit breaker 19. Although the output from the generator is shown in FIG. 1 as single phase, the generator usually provides three phase or other forms of output power in which case a corresponding number of circuit breakers are required.

In accordance with the invention, governor valves GV1 and GV4, (for example, which are the last valves to open at 100% power in the sequential valve mode) are rapidly closed by the operation of solenoid valves GVS1 and GVS4, and governor valves GV2 and GV3, for example, are rapidly operated toward a predetermined partially closed position, as described in connection with FIGS. 2 and 3. Solenoid valves GVS1 and GVS4 control the hydraulic actuators generally referred to at 20', as described in connection with FIG. 5. Hydraulic actuators 21 through 24 control the operation of the respective interceptor valves IV1 through IV4. Solenoid valves FOIV1 through FOIV4, and solenoid valves CL1 through CL4 govern their associated actuator 21 through 24 to operate the interceptor valves IV as described in connection with FIG. 4. A fast valving system 25 controls the intercept valves, governor valves, and EH system 9 as described herein. A conventional loss of load or fault detector 26 is coupled to the output of the generator 14 or to the transmission line, if desired, to provide an initiation signal for the fast valving system 25 in response to the detection of a partial loss of load. A signal is provided by a circuit breaker detector 27 to provide information to the system 25 relative to the circuit breaker state. A speed detector 28 provides a signal or representation indicative of the rotational velocity of the turbine generator shaft. All of the above-described transducers may be of any suitable design well known in the art. The EH control system 9 which may be either analog or digital, generates a total steam flow demand signal on line 29 to control the actuators 20' to govern the valves to admit a predetermined steam flow to the turbine section 10. The fast valving system 25 is connected to the system 9 to apply a predetermined valve position demand signal, change the governor valve limit signal, and render the impulse pressure feedback loop ineffective, as well as to change the total steam flow demand reference signal.

Figure 2:
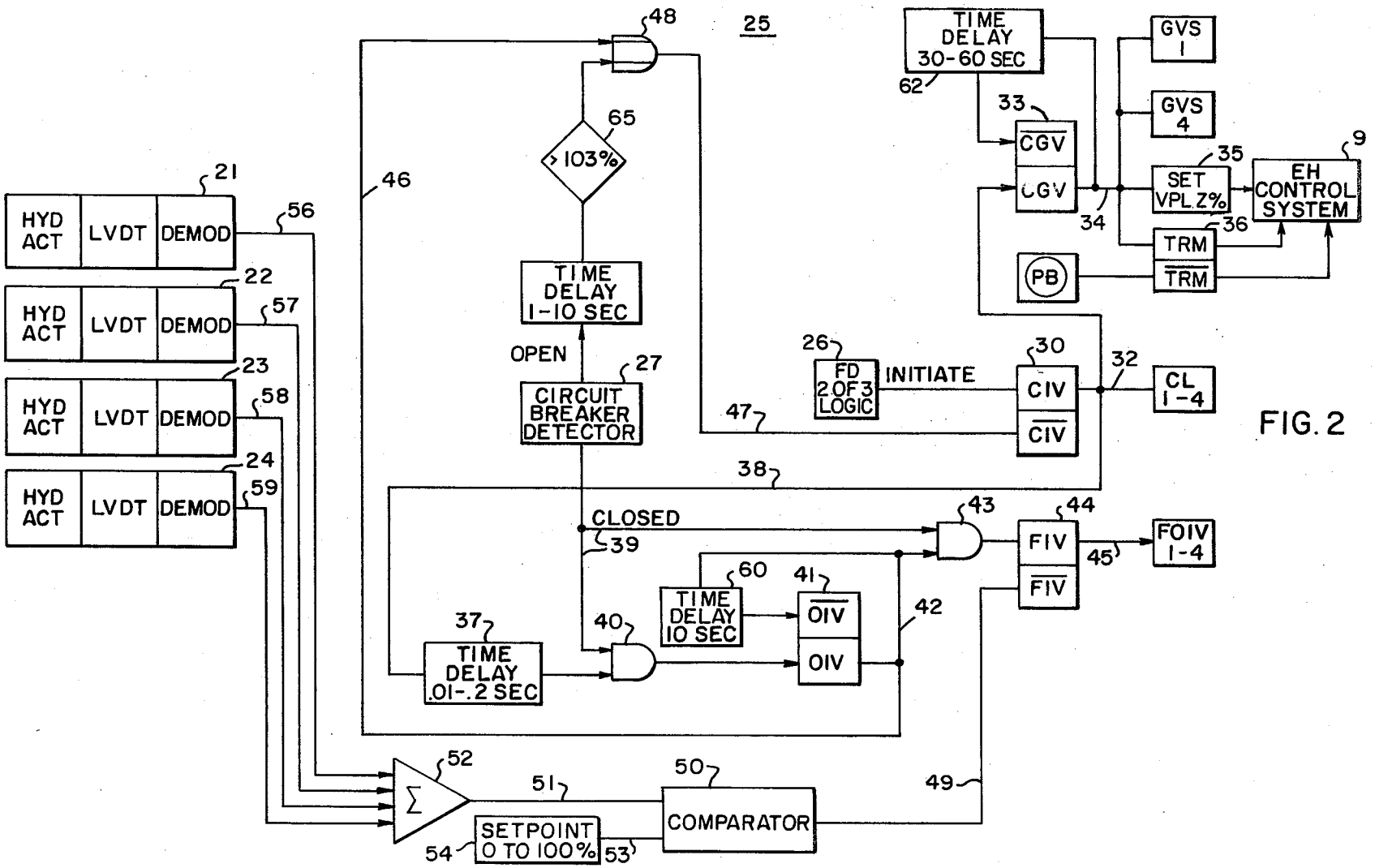
FIG. 2 is a schematic block diagram of a fast valving system in accordance with one embodiment of the present invention.

Referring both to FIGS. 1 and 2, the fast valving system 25 in response to an initiation signal from the fault detector 26, operates a flip-flop circuit 30 to its state shown as CIV to generate an output signal which energizes the solenoid valves CL1 through CL4 over lines referred to as 32 to rapidly close its respective intercept valve IV1–IV4 in a manner to be described in detail. In response to the operation of the flip-flop circuit 30 to its state CIV, a flip-flop circuit 33 is operated to its state CGV to generate an output on line 34 to energize the solenoid valves GVS1 and GVS4 for closing governor valves GV1 and GV4, and at the same time to apply a predetermined voltage to the governor valves and change the governor valve position limit illustrated by block 35 and transfer the EH system 9 to manual through the operation of flip-flop circuit 36 to its state TRM which disconnects the impulse pressure feedback loop. The response of the valve position demand signal to the lowering of the limit signal changes the reference demand signal as described in connection with FIG. 3.

In automatic control, the typical EH system, such as 9, has the impulse pressure feedback loop in service, but in manual control, where the operator can change the reference demand signal, the impulse feedback loop is out of service. Of course, if the system is not in automatic at the time of a partial load reduction, the loop is out of service. The details of transferring the EH system to manual and the disconnecting of the feedback loop are well known to those skilled in the art and form no part of the present invention. It is contemplated that the impulse pressure feedback loop effect could be eliminated in other ways such as by relay disconnect, or a bias signal, for example. For example, the EH controller 9 may be of the type described in the referenced copending application which is incorporated by reference herein, and of the type described in U.S. Pat. No. 3,552,872. The manner in which the solenoid valves GVS1 and GVS4 rapidly close their respective governor valves GV1 and GV4 is described in more detail in connection with FIG. 5. The operation of the flip-flop circuit 30 to its CIV state in response to the initiation signal from the fault detector 26 also starts the operation of a time delay circuit represented at block 37 over a line 38. This time delay circuit 37 may be any conventional time delay mechanism that functions to delay the output signal to AND gate 40 to generate a signal for a time period such as in the order of 0.01 to 0.2 seconds, for example. The circuit breaker detector 27, provided that the breaker 19 is closed, generates an output on line 39. The lines 38 and 39 complete the input to AND gate 40 so that the closed circuit breaker condition and the time delay of block 37' operates a flip-flop circuit 41 to its state OIV to provide a signal on line 42, which is input to an AND gate 43 with the line 39 to operate a flip-flop circuit 44 to its state FIV to energize the solenoid valves FOIV1 through FOIV4 over lines 45, after the dump valve has reseated as indicated by pressure switch 110 (FIG. 4) which restores rapidly a partial total flow to the LP turbine section 12. The operation of the flip-flop circuit 41 to its state OIV also operates the flip-flop circuit CIV to its state CIV over lines 46 and 47 through OR gate 48, which deenergizes the solenoid valves CL1 through CL4 that were energized previously for closing the interceptor valves.

All fast opening solenoid valves FOIV are deenergized in response to a signal representative of a total desired steam flow to the LP turbine section 12, which thereafter permits further opening of the interceptor valves IV1 through IV4 at the slower normal control rate as described hereinafter. This function of the system is implemented by generating an output on line 49 from a comparator 50 for operating the flip-flop 44 to state FIV in response to the comparison of a signal on line 51 at the output of an adder 52 with a predetermined setpoint signal on line 53 at the output of a voltage source or digital signal generator 54. The signal generator 54 represents the total desired steam flow to the LP turbine, or a signal representative of an additive desired valve position of all the interceptor valves IV. The device 54 may be adjustable for various installation and conditions, but a signal representing approximately a 63% desired total steam flow, for example, is preferred. The comparator 50 may be any well-known type of analog or digital comparator that compares a digital signal or a predetermined analog voltage with another signal to produce a desired output in response to a predetermined relationship between the two signals. The inputs to the summing device 52 are demodulated position signals from each respective servo system of the valves IV1 through IV4 on lines 56, 57, 58, 59. The output on line 51 of the summer 52 is a signal representing the sum of all of the actual interceptor valve positions. To obtain a signal representative of these positions, for input to the summing device 52, a linear variable differential transformer (LVDT) is utilized to generate a signal that is demodulated in a well known manner. A servo control loop, which provides an output signal in accordance with the actual position of the valve, and which may be used in the system of the present invention is described in detail in U.S. Pat. Application Ser. No. 660,747, filed by T. H. Schwalenstock and W. E. Zitelli on Feb. 23, 1976 to which reference and incorporation herein is made for a detailed description thereof.

Also in response to the operation of the flip-flop circuit to its position OIV a conventional timer 60 is started to produce an output at the operation of a time delay of 10 seconds, for example, to operate the flip-flop circuit 41 to its condition $\overline{\text{OIV}}$ which places the system in its normal position to operate the interceptor valves IV in response to another partial loss of load.

After a time delay, adjustable from thirty to sixty seconds for example, as represented by block 62, from the time that the flip-flop 33 was set to its state CGV, the flip-flop is reset to state $\overline{\text{CGV}}$. The resetting of flip-flop 33 to state $\overline{\text{CGV}}$ deenergizes the solenoid valves GVS1 and GVS4 to render the valves responsive to the changed valve position limit of the EH controller 9, and perform other functions as described in connection with FIG. 3.

In the event that the partial loss of load should result in the main circuit breaker opening as indicated by an output on line 65 from the detector 27 the speed of the turbine generator is checked by the detector 28 (FIG. 1) and in the event that such speed is less than 103% as indicated by block 65, after a delay of from one to 10 seconds, for example, the flip-flop circuit 30 is reset through the OR gate 48 over the line 47, to its state $\overline{\text{CIV}}$ to reset the system for operation of the interceptor valves in response to a subsequent partial loss of load.

Figure 3:
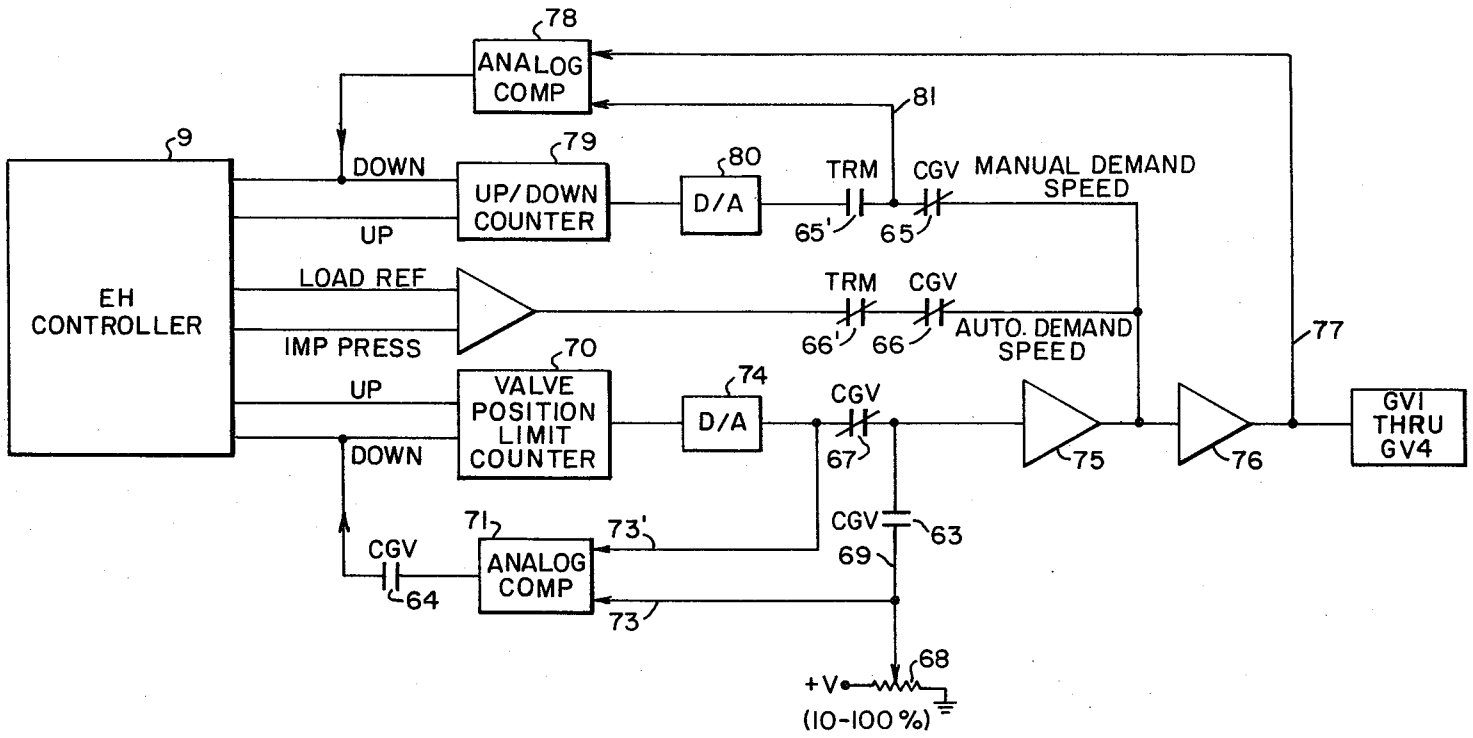
FIG. 3 shows a more detailed schematic block diagram for changing the valve position limits and demand signals in accordance with the invention.

Referring to FIG. 3, the circuitry may be either part of the EH controller 9 or connected thereto. In response to the flip-flop 33 operating to its state CGV indicating a partial loss of load as previously described, the flip-flop circuit 37 operates to its state TRM, all of which causes CGV contacts 63 and 64 close and contacts 65, 66 and 67 open, and TRM contacts 65' to close and 66' to open. This may be accomplished by a conventional relay coil (not shown) responsive to the CGV, TRM state of the flip-flops 30 and 33 respectively. A potentiometer 68 is preset to provide a position setpoint voltage on line 69 for the governor valves GV1 through GV4 of approximately 63%. The closing of the contact 64 operates a counter 70 through an analog comparator 71. The voltage to the lower terminal 72 of the counter 70 decreases its output until the voltage on lines 73 and 73' are equal, which stops the counter 70 at the decreased governor valve position setpoint. A D/A converter 74 converts the output of the counter 70 to the analog voltage for input to the comparator 71 over the line 73'. The setpoint voltage from 68 is also conducted through the closed contact 63 and through conventional summing amplifiers 75 and 76 to partially close rapidly those governor valves GV2 and GV3 which are not fully closed. The open contacts 65 and 66 disconnect both the automatic and the manual control signal from the GV valves as shown. The opening of the contact 66' disconnects the impulse pressure feedback loop and the closing of the contact 65' permits the manual control signal to track the voltage at the output of summing amplifier 76. Also, the signal on line 77 is conducted through a comparator 78 for lowering the output of a counter 79, which is the conventional manual control signal for operating the governor valves GV. The output of the counter 79 is converted to an analog signal by a D/A converter 80 and stops the counter where the signal on 77 and 81 are equal. Thus, the governor valves GV1 and GV4 are positioned by the voltage solely from the setpoint potentiometer 68. During this period, the valve position limit signal and the reference demand signal are being runback in accordance with the value of the signal from the source 68. As previously mentioned, the valve position limit rate of change is much faster than the rate of change of the reference demand signal. At the termination of a time delay 62, the flip-flop 33 operates to its state $\overline{CGV}$ which closes the contact 67 and opens the contacts 63 and 64, and also deenergizes solenoid valves GVS1 and GVS4. Thus, the governor valves GV1 through GV4 are operated to a position as controlled by the governor valve limit position signal. At such time as the reference demand signal reaches the value of the limit position signal, the operator can control the system normally in the manual mode. A pushbutton PB (FIG. 2) may be operated to put the system in automatic mode by operating the flip-flop to its state $\overline{TRM}$, which opens the contact 65' and closes the contact 66'.

Figure 4:
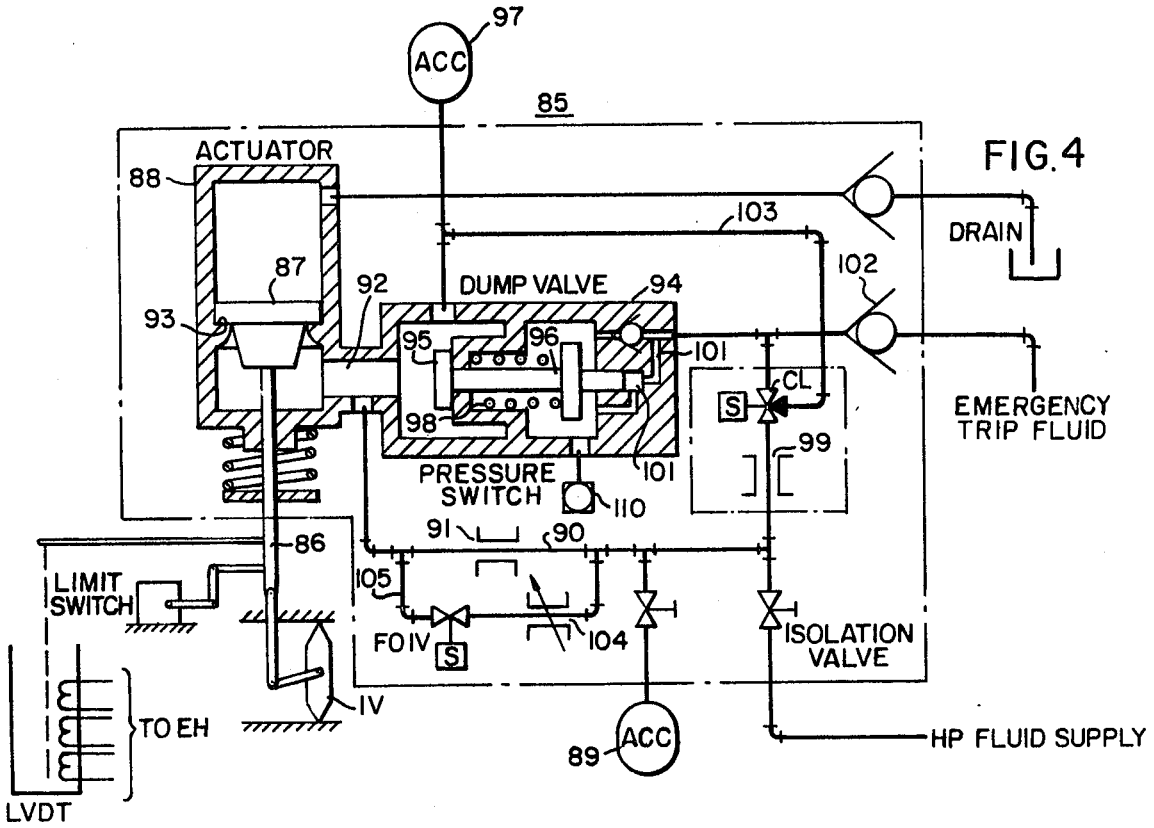
FIG. 4 is a schematic illustration of a hydraulic system for a typical intercepter valve which is operated by the system of FIG. 2.

Referring to FIG. 4, the hydraulic portion of the system for the operation of interceptor valves IV1–IV4 according to the present invention is referred to generally at 85. Each intercept valve is operated by an actuator 86 which has attached at one end a piston 87 that is slidably mounted in a cylinder 88. The valve IV is normally opened by the introduction of fluid under pressure from an accumulator 89 through a line 90, an orifice 91, and a chamber 92 to lift the piston 87 off of its seat 93 and move upwardly in the cylinder or chamber 88. A dump valve 94 has a plug 95 on a movable member 96 to close off the chamber 92 to prevent fluid under pressure from escaping into an accumulator 97. The dump valve 94 is operated to the position for closing off the chamber 92 against the force of a spring 98 by the introduction of fluid under pressure through line 90, a metering orifice 99 and the normally open deenergized solenoid valve CL, and line 100 into a chamber 101. The solenoid valve CL is a three way solenoid and in its deenergized position, permits the valve IV to be opened hydraulically, as previously described. Although the conventional interceptor valve takes about 30 seconds to open, it can rapidly close by the operation of the dump valve 94 to the position as shown in the FIG. 5. This can be accomplished either through an emergency trip check valve 102 or by releasing the pressure in the line 100 by energizing the solenoid valve CL to bypass such pressure through line 103 to the accumulator 97 and drain. This release of pressure of course causes the dump valve member 95 to open the chamber 92 and permit the fluid to be quickly released into the accumulator 97 through the valve CL. The above-described portion of the hydraulic system is included in conventional IV valves.

However, in order to rapidly open the interceptor valve IV, the solenoid valve FOIV, is energized and CL deenergized. The fluid from the accumulator 89 flows through an orifice 104 and the solenoid valve FOIV in a bypass line 105. The orifice 104 is larger than the orifice 91 to more rapidly permit the entrance of fluid through 104 and 91 into the chamber 92 for opening the valve IV upon the energizing of the solenoid FOIV. With the bypass arrangement in connection with the solenoid FOIV for each of the interceptor valves IV, the fluid under pressure rapidly enters the chamber 92 and forces the actuator upward in the chamber 88 until such solenoid valve FOIV is again deenergized which restricts the path of the fluid through the smaller orifice 91 only.

Thus, it can be seen from the description of the system in connection with FIG. 2 that the energizing of the solenoid CL causes a rapid closing of the valve; and the energizing of the solenoid valve FOIV causes a rapid opening as long as such solenoid valve is energized. A pressure switch 110 may be used in a conventional manner for insuring that the dump valve 96 is closed prior to opening of valve IV. The LVDT is connected mechanically to the actuator rod 86 and changes the inductance in the linear variable differential transformer as previously described.

Figure 5:
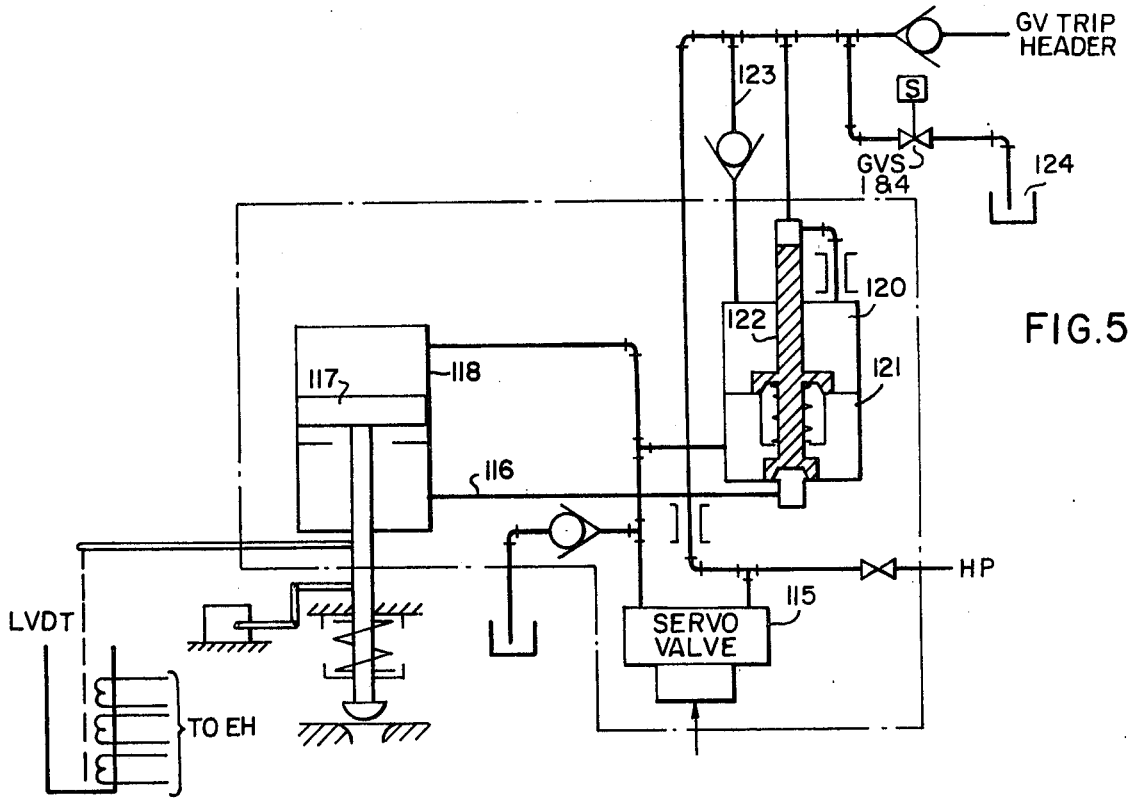
FIG. 5 is a schematic diagram of the hydraulic system for a typical governor valve that is operated by the system of FIG. 2.

Referring to FIG. 5, one of the governor valves GV1 or GV4, which is rapidly closed independent of the EH system, is illustrated schematically to show its operation in response to the energizing of its respective solenoid valve GVS1 and GVS4. The governor valve GV includes a conventional servo valve mechanism 115 that operates to admit fluid through a line 116 to control the position of a rod and piston 117 in a chamber 118 to regulate the degree of opening of the valve. To rapidly close the valve, the solenoid valve GVS which is connected upstream in parallel with the governor valve trip header is energized to release the fluid pressure from chamber 120 of an actuator valve 121. The release of this pressure causes the member 122 to move upwardly and permit the line 116 to communciate with the chamber 120 thereby causing the fluid pressure to release through a line 123 and the open solenoid valve GVS to a drain 124. When the solenoid valve GVS is deenergized, it closes, permitting the governor valve to be controlled by the servo valve mechanism 115 in a conventional well known manner.

In summary, the system responds to a partial load reduction by simultaneously closing all of the interceptor valves and a portion of the governor valves, such as GV1 and GV4 rapidly by the energizing of solenoid valves CL1 through CL4 and GVS1 and GVS4, as previously described, independent of the normal operation of the turbine control system. At the same time, a predetermined total position demand signal for the governor valves is applied to operate the remaining governor valves to a predetermined partially closed condition and the impulse pressure feedback loop is taken out of service.

The interceptor valves are rapidly opened partially to permit a predetermined resumption of steam flow to the lower pressure turbine section is determined by an additive valve position signal to compensate for sticking of one or more intercept valves. At such predetermined additive position, the interceptor valves are operated to a fully open position at a normal rate. During this time the valve position limit signal for the governor valves is reduced to match the applied total demand signal, and the reference demand signal for the valves is ramped downwardly at a slower rate to be equal to the applied total position demand signal. After a time delay of from 30 to 60 seconds for example, the applied total demand signal is removed, and the governor valves which were fully closed now open to the amount permitted by the valve position limit signal. The reduced normal manual reference demand signal is also runback to match the valve position limit signal. Thus, normal control may be resumed by the EH controller in the manual mode bumplessly for sustained operation at a desired reduced load. The operator can operate a button to thereafter return the EH system to automatic control, and cut in the impulse pressure feedback loop if desired.

It is understood that various additions and changes can be made in the system without departing from the spirit or scope of the invention. For example, a different number of governor valves can be fully closed or partially closed depending on the installation, and different numbers of intercept valves may be used. Further, the logic of the system may be implemented in digital form by microprocessor or otherwise where desired, and depending on the installation, steam can be bypassed around the lower pressure turbine section with the rapid closing of the interceptor valves, if desired.

What we claim is:

1. A system for momentarily interrupting the total steam flow to the lower pressure turbine section of a power plant upon the occurrence of a partial loss of electrical load, comprising:

(a) a plurality of electrohydraulically adapted interceptor valves for controlling the admission of motive steam to the lower pressure turbine section, each said valve having a servo system operative to generate an electrical signal representative of its actual valve position, (b) means to combine the generated actual position signals of each of the valves, (c) means response to a detection of partial loss of electrical load to operate each of the plurality of interceptor valves from an open to a substantially closed condition, (d) means to control the interceptor valves to operate at a predetermined speed toward an open position, and (e) means governed by the combined actual valve position signals to change the controlled speed of opening each of the interceptor valves.

2. A system according to claim 1 wherein the means to control the valves to operate at said predetermined speed includes:

means for bypassing the hydraulic fluid, means for each interceptor valve to conduct hydraulic fluid through a first orifice of a predetermined size to control the rate of flow for operating its valve at one rate of speed, a solenoid valve for each interceptor valve activated subsequent to closing of its interceptor valve upon a partial loss of load, and means responsive to the activation of each solenoid valve to conduct the hydraulic fluid through a second orifice of a predetermined size larger than the first orifice to control the rate of flow for operating its valve at said predetermined rate of speed, said rate of speed being greater than the one rate of speed.

3. A system for rapidly reducing the total steam flow to the high and lower turbine section of a power plant upon the occurrence of a partial loss of electrical load, comprising:

a plurality of governor valves for controlling the admission of motive steam to the high pressure section, a plurality of interceptor valves for controlling the admission of motive steam to the lower pressure section, means for generating an electrical reference demand signal for varying the position of the governor valves at a first predetermined rate for governing the electrical load, means to generate a signal for effectively limiting the value of the generated reference demand signal to control the open limit position of said valves, means operative when activated to change the limit signal value of said limiting means at a second predetermined rate faster than said first rate, first means responsive to a detection of a partial loss of electrical load to first substantially close and then open the plurality of interceptor valves, second means responsive to the detection of the partial loss of electrical load to close one portion of the governor valves independent of the value of the reference demand signal value concomitantly with the closing of the interceptor valves, third means responsive to the detection of the partial loss of electrical load to generate a predetermined signal to activate the limit changing means to reduce the open position limit signal of all the governor valves and to change the position of another portion of the governor valves in accordance with said predetermined signal, and means to control all of the governor valves in accordance with the changed value of the limit signal upon the expiration of a predetermined time interval to reduce the total flow of steam to the turbine.

4. A system according to claim 3, further comprising means governed by the third means to change the reference demand signal to a value corresponding to the changed value of the limit signal, whereby the reference demand signal is capable of change at the first predetermined rate to below the value of the changed limit signal without an abrupt change in the valve position.

5. A system according to claim 3 further comprising an impulse pressure feedback loop effective at times for operating the governor valves to produce a predetermined load output irrespective of variation in the impulse pressure of the motive steam, and means responsive to a partial loss of electrical load to eliminate the effect of said loop on the operation of the governor valves.

6. A system according to claim 3 wherein each of the interceptor valves includes a servo system operative to generate an electrical signal representative of its valve position, and wherein said first means includes:

(a) means to combine the generated position signals of all the interceptor valves, (b) means to control the interceptor valves to operate at a predetermined speed toward an open position, and (c) means governed by the combined position signal to change the controlled speed of opening each of the interceptor valves.

7. In an electrohydraulic turbine power plant control system capable of operating in an automatic mode when a reference demand signal is varied automatically at a predetermined rate to generate a predetermined electrical load, and resetting in a manual mode wherein the reference demand signal is capable of being varied manually at said predetermined rate and wherein the reference demand signal is capable of being adjustably limited to prevent full opening of the governor valves; the improvement of a system for rapidly reducing the steam flow to the high and lower pressure turbine sections to effect a sustained reduction in load upon the occurrence of a partial loss of electrical load; said system comprising:

(a) a plurality of governor valves and a plurality of interceptor valves for controlling the admission of steam to the high or lower pressure turbine sections respectively, said governor valves being normally controlled by the reference demand signal in both the manual and automatic mode;

(b) fast valving means responsive to the detection of a partial loss of electrical load to operate the interceptor valves to a closed and open position, switch the electrohydraulic control system to manual mode, operate one portion of the governor valves to a closed and predetermined partially open position, operate another portion of the governor valves to a predetermined partially open position;

said fast valving means for operating the governor valves including, means to close the one portion independent of the reference demand signal, means to change the limit of the reference demand signal, and means to restore control of all the governor valves to the limited reference demand signal.

8. In an electrohydraulic turbine power plant control system capable of operating in an automatic mode when a reference demand signal is varied automatically at a predetermined rate to generate a predetermined electrical load, and resetting in a manual mode wherein the reference demand signal is capable of being varied manually at said predetermined rate and wherein the reference demand signal is capable of being adjustably limited to prevent full opening of the governor valves; the improvement of a system for rapidly reducing the steam flow to the high and lower pressure turbine sections to effect a sustained reduction in load upon the occurrence of a partial loss of electrical load; said system comprising:

(a) a plurality of governor valves and a plurality of interceptor valves for controlling the admission of steam to the high or lower pressure turbine sections respectively, said governor valves being normally controlled by the reference demand signal in both the manual and automatic mode;

(b) fast valving means responsive to the detection of a partial loss of electrical load to operate the interceptor valves to a closed and open position, switch the electrohydraulic control system to manual mode, operate one portion of the governor valves to a closed and predetermined partially open position, operate another portion of the governor valves to a predetermined partially open position;

said fast valving means for operating the interceptor valve means including, means to generate a signal corresponding to the actual position of each interceptor valve, means to open the interceptor valves at two different predetermined rates of speed, and means to combine the generated position signal of each of the interceptor valves, and means to change the rate of speed of opening of all the interceptor valves in accordance with the combined signal.

9. A system for momentarily interrupting the total steam flow to the lower pressure turbine section of a power plant upon the occurrence of a partial loss of electrical load, comprising:

(a) a plurality of electrohydraulically adapted interceptor valves for controlling the admission of motive steam to the lower pressure turbine section, each said valve having a servo system operative to generate an electrical signal representative of its actual valve position.

(b) means for generating a signal representative of the total steam flow admitted by the interceptor valves as a function of said actual valve position signals, (c) means responsive to the detection of a partial loss of electrical load to operate each of the plurality of interceptor valves from an open to a substantially closed condition, (d) means to control the interceptor valves to operate at a predetermined speed toward an open position, and (e) means governed by the value of said interceptor valve total steam flow signal to change the controlled speed of opening each of the interceptor valves.

10. The system in accordance with claim 9 including means for inhibiting a predetermined time interval upon the detection of the partial loss of load, wherein said control means is responsive to the termination of said predetermined time interval to operate each of the plurality of interceptor valves toward an open position at a first rate of speed, and wherein said changing means changes the controlled speed of opening each of the interceptor valves from said first rate of speed to a substantially slower second rate of speed when the value of the interceptor valve total steam flow signal is substantially equal to a predetermined value.

* * * * *